US006250752B1

(12) United States Patent
Tajima et al.

(10) Patent No.: US 6,250,752 B1
(45) Date of Patent: Jun. 26, 2001

(54) INK SUPPLY DEVICE AND INK-JET RECORDING HEAD WITH FILTER AND SHAPED FLOW PASSAGE

(75) Inventors: Hiroki Tajima; Seiichiro Karita, both of Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/330,026

(22) Filed: Jun. 11, 1999

(30) Foreign Application Priority Data

Jun. 17, 1998 (JP) ..... 10-169891
May 28, 1999 (JP) ..... 11-150508

(51) Int. Cl.[7] ..... B41J 2/19; B41J 2/175
(52) U.S. Cl. ..... 347/92; 347/93
(58) Field of Search ..... 347/93, 92, 85

(56) References Cited

U.S. PATENT DOCUMENTS

| | | | | |
|---|---|---|---|---|
| 4,313,124 | | 1/1982 | Hara | 347/59 |
| 4,320,407 | * | 3/1982 | Goldis et al. | 347/93 X |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,723,129 | | 2/1988 | Endo et al. | 347/56 |
| 4,740,796 | | 4/1988 | Endo et al. | 347/56 |
| 4,931,811 | * | 6/1990 | Cowger et al. | 347/93 X |
| 5,216,446 | | 6/1993 | Satoi et al. | 347/65 |
| 5,237,342 | | 8/1993 | Saikawa et al. | 347/87 |
| 5,502,479 | | 3/1996 | Ishinaga et al. | 347/93 |

FOREIGN PATENT DOCUMENTS

| | | | | |
|---|---|---|---|---|
| 196 13 654 | | 10/1996 | (DE) . | |
| 596252 | | 5/1994 | (EP) . | |
| 609863 | | 8/1994 | (EP) . | |
| 683050 | | 11/1995 | (EP) . | |
| 2299786 | | 10/1996 | (GB) . | |
| 2236847 | | 1/1999 | (GB) . | |
| 2326845 | | 1/1999 | (GB) . | |
| 2326846 | | 1/1999 | (GB) . | |
| 54-056847 | | 5/1979 | (JP) . | |
| 59-123670 | | 7/1984 | (JP) . | |
| 59-138461 | | 8/1984 | (JP) . | |
| 60-71260 | | 4/1985 | (JP) . | |
| 5-207712 | | 8/1993 | (JP) . | |
| 5-207714 | | 8/1993 | (JP) . | |
| 1790436 A3 | * | 1/1993 | (SU) | B01D/47/00 |

* cited by examiner

*Primary Examiner*—David F. Yockey
(74) *Attorney, Agent, or Firm*—Fitzpatrick, Cella, Harper & Scinto

(57) ABSTRACT

An ink supply device having an ink flow passage for communicating an ink containing part for containing an ink with a discharge part for discharging the ink, the ink flow passage is characterized by a filter device including a filter and a filter box for containing the filter and provided with an ink inlet port and an ink outlet port, wherein an area at the ink inlet port side of the filter box is disposed beneath an area at the ink outlet port side of the filter box, and an inside diameter of ink flow passage at the ink inlet port side of the filter box is narrowed in a diameter to be smaller than an inside diameter of the ink flow passage immediately before expanding into a bell-bottomed shape towards the filter.

9 Claims, 4 Drawing Sheets

INK SUPPLY DEVICE AND INK-JET RECORDING HEAD WITH FILTER AND SHAPED FLOW PASSAGE

This application is based on Japanese Patent Application No. 10-169891 (1998) filed Jun. 17, 1998 and Japanese Patent Application No. 11-150508 (1999) filed May 28, 1999 the contents of which are incorporated hereinto by reference.

BACKGROUND OF THE INVENTION

1. Field of the Invention

The present invention relates to an ink supply device and a recording head of an ink-jet recording apparatus for discharging flying liquid drops of ink as a recording liquid as ink droplets from a discharge port to perform recording on recording paper, more concretely to an ink supply device which is provided with a removing device for removing dust, and to a recording head.

2. Description of the Related Art

In an ink-jet recording head, it is constructed so as to supply ink to a common chamber communicating with a discharge port, in which a filter device having a filter for preventing contamination with fine dust or the like which may be a cause of nozzle clogging is provided in a passage for introducing the ink supplied from an ink tank. Such filter device is generally of a type in which a filter box is connected to a pipe for introducing the ink. A filter is disposed in the filter box, and the diameter of the filter is normally larger than the diameter of the pipe. For this reason, an inside diameter of the pipe in the vicinity of the filter is increased towards the filter diameter, resulting in a bell-bottomed shape of the pipe of this portion.

However, if an expanded portion of a flow passage such as a bell-bottomed portion is present in a filter device of an ink supply device, the ink flow rate is decreased at this portion resulting in a stagnation of the ink, and a bubble is liable to generate in the vicinity of the filter. Further, a once-generated bubble does not readily disappear but tends to adhere to the filter. As a result, an effective area of the filter is decreased, which may disturb an ink refill, leading to an unstable discharge or a discharge failure due to an insufficient ink refill.

SUMMARY OF THE INVENTION

In order to solve such problems in the prior arts, it is an object of the present invention to provide a highly reliable ink supply device and an ink-jet recording head having a filter device which does not generate a bubble in the vicinity of the filter in the filter box, or even if generates, has a structure capable of immediately defoaming, thereby preventing an occurrence of an unstable discharge or an insufficient ink refill.

In accordance with the present invention which attains the above object, there is provided an ink supply device having an ink flow passage for communicating an ink containing part for containing an ink with a discharge part for discharging the ink, the ink flow passage is characterized by a filter device including a filter and a filter box for containing the filter and provided with an ink inlet port and an ink outlet port, wherein an area at the ink inlet port side of the filter box is disposed beneath an area at the ink outlet port side of the filter box, and an inside diameter of the ink flow passage at the ink inlet port side of the filter box is narrowed in a diameter to be smaller than the inside diameter of the ink flow passage immediately before expanding into a bell-bottomed shape towards the filter.

Further, an ink-jet recording head according to the present invention for discharging an ink comprises a filter device having a filter and a filter box for containing the filter and provided with an ink inlet port and an ink outlet port, the filter and the filter box provided in a passage for supplying the ink to the ink-jet recording head, wherein an area at the ink inlet port side of the filter box is disposed beneath an area at the ink outlet port side of the filter box, and an inside diameter of the ink flow passage at the ink inlet port side of the filter box is narrowed in diameter to be smaller than an inside diameter of the ink flow passage immediately before expanding into a bell-bottomed shape towards the filter.

According to the above-described ink supply device and the ink-jet recording head, the flow rate of the ink passing through the narrowed orifice-formed part is increased, which is offset each other by a mutual effect of a relaxation of an ink flow rate in a box member having a cross-sectional area expanding in a bell-bottomed shape towards the filter having a large diameter, thereby preventing an occurrence of a generation of a bubble due to a stagnation of an ink flow and obtaining a highly reliable ink supply device and an ink-jet recording head without an unstable ink discharge or an insufficient ink refill.

The above and other objects, effects, features and advantages of the present invention will become more apparent from the following description of the embodiments thereof taken in conjunction with the accompanying drawings.

DETAILED DESCRIPTION OF THE PREFERRED EMBODIMENTS

Next, the embodiments of the present invention will be described with reference to the drawings.

(Embodiment 1)

Figure 1:
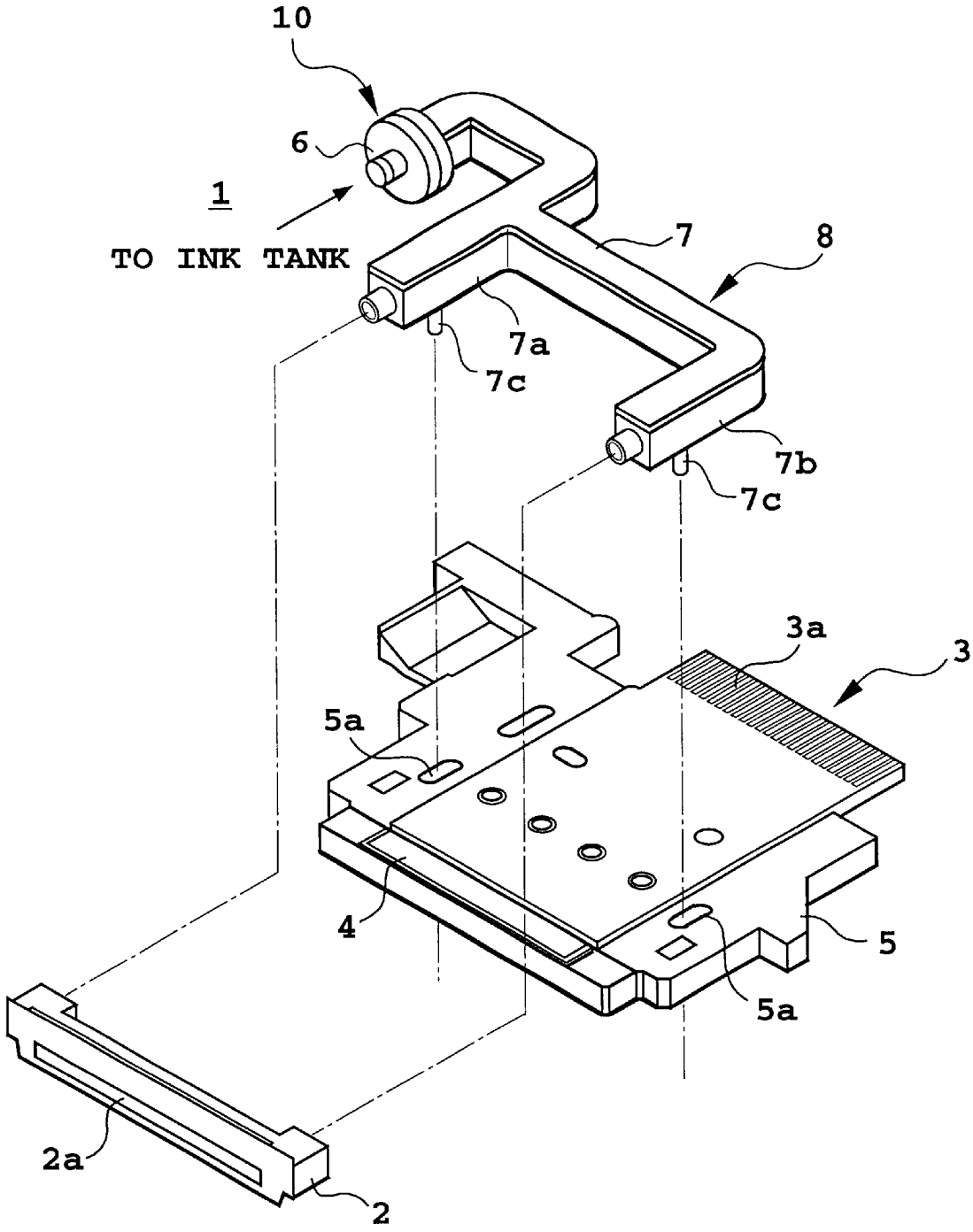
FIG. 1 is an exploded perspective view showing the shape of the ink-jet recording head according to the present invention.

FIG. 1 is a perspective view showing the shape of an ink-jet recording head 1 according to the present invention, and FIG. 2 is a schematic view of a filter box which is best showing the feature of the ink-jet recording head of the present invention.

As shown in FIG. 1, the ink-jet recording head 1 of the present invention is constructed integrally from an electrothermal converter (electrothermal conversion element) which is film-formed on a substrate by means of a semiconductor production process such as etching, deposition, sputtering and the like, an ink flow passage having a common liquid chamber, a grooved ceiling plate 2 which is a discharge port formation member having an electrode and a discharge port (nozzle), a base plate 5 having a printed circuit board 3 and a heater board 4, an ink supply system unit 8 having an ink supply pipe passage 7 provided with a filter device 10 having a filter box 6, and the like. A recording ink is supplied from an ink tank to a rear part at both ends of the grooved ceiling plate 2 which is a formation member of the discharge port, an ink flow passage and a common liquid chamber of the ink-jet recording head 1.

The ink supply pipe passage 7 of the ink supply system unit 8 is adapted to be connected with a piping from the ink tank, and a filter device 10 is provided at the connection part which has a filter box 6 provided with a filter for preventing contamination with fine dust and the like from the ink tank. At the downstream side of the filter device 10, the ink supply pipe passage 7 is branched into branch pipe passages 7*a* an 7*b*, tips of the respective branch pipe passages 7*a* and 7*b* being connected to both ends of the grooved ceiling plate 2, and the mounting protrusions 7*c* and 7*c* provided halfway in the branched pipe passages 7*a* and 7*b* are mounted respectively to the mounting holes 5*a* and 5*a* of the base plate 5.

The ink supplied to the ink-jet recording head 1 of the above construction is supplied by a capillary phenomenon into an ink liquid passage formed of the grooved ceiling plate 2, and stably held by forming a meniscus on an ink discharge port surface at the tip of the liquid passage.

Here, by energizing the electrothermal converter through an electrode terminal 3*a* of the printed circuit board 3, the ink on the electrothermal converter surface is heated to generate a bubbling phenomenon by boiling in the ink, and the ink is discharged by an energy of the bubble generation as a flying liquid drop from an ink discharge port surface 2*a* of the grooved ceiling plate 2. In the case of the thus constructed present embodiment, the ink-jet recording method is an ink-jet method of a type for discharging a liquid by a thermal energy, and by arranging the ink discharge ports in a high density, a very fine recording can be achieved.

Figure 2A:
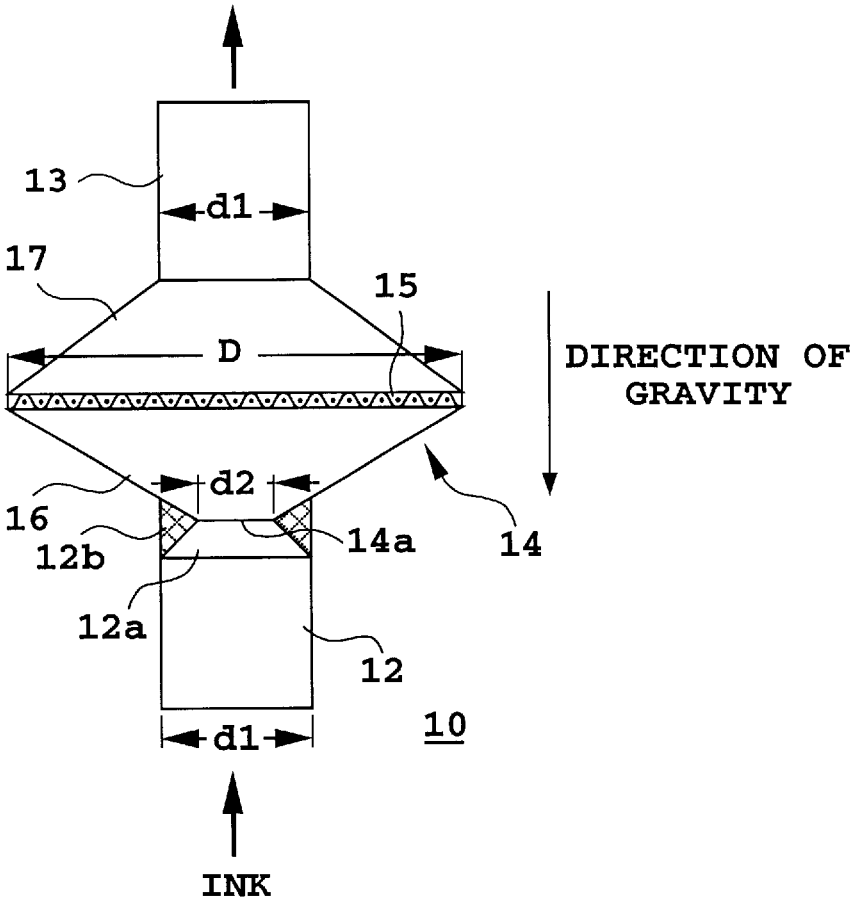
FIGS. 2A and 2B are respective views for explaining the ink-jet recording head according to the present invention, in which 2A is a vertical sectional view of a filter box, and 2B is a plane view of a filter.
Figure 2B:
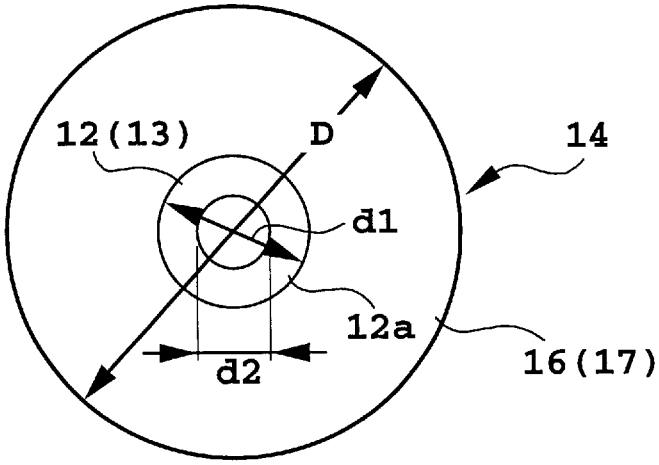

In the constructed ink supply system unit 8, the filter device 10 of the present invention, as shown in FIGS. 2A and 2B, comprises two truncated conical box members 16 and 17 joined in the opposite directions, and a filter box 14 having a filter 16 provided in the joined portion between these box members 16 and 17. An inlet side pipe 12 is connected to an inlet port of the box member 16, on the other hand, an outlet side pipe 13 is connected to an outlet of the box member 17. Further, a tip part 12*a* of the inlet side pipe 12 is provided with a protruded portion 12*b* on its entire inner periphery, thus forming the tip.

In the filter box 14, the ink inlet side filter box member 16 is disposed beneath the ink outlet side filter box member 17 through the filter 15 so that the ink flow is in a vertical upward direction. That is, in the recording head shown in FIG. 1, the discharge port is used in a vertical downward direction.

Therefore, the filter box 14 provided with the filter 15 has a so-called abacus bead form in which two truncated conical box members 16 and 17 are joined with each other in the opposite directions at the bottom surface sides, the filter 15 of a diameter D is integrally formed at the joined portion at the center of the filter box 14, the inlet side pipe 12 of a diameter d1 is connected at the ink inlet side, and the outlet side pipe 13 of the same diameter d1 is connected at the ink outlet side.

The walls for these inlet side pipe 12 and outlet side pipe 13, the box members 16 and 17 of the filter box 14 and the like are not shown in the figure, and can be formed in the appropriate thicknesses. Further, when the filter box 14 is made of a transparent or translucent synthetic resin or the like, it is advantageous for checking the inside state visually.

Specifically, as shown in the figures, the inlet side pipe 12 and the outlet side pipe 13 are both made of a pipe having the same diameter d1, further, the tip part 12*a* of the inlet side pipe 12 is tapered to a diameter d2 at the inlet port 14*a* into the filter box 14. That is, the outlet port of the tip part 12*a* of the inlet side pipe 12 is the inlet port 14*a* of the filter box 14, forming an orifice of a diameter d2. Therefore, the inlet port 14*a* of the filter box 14 also has a diameter d2.

Since a "constricted" part as shown in the figure is formed at the connection part between the tip part 12*a* of the inlet side pipe 12 and the inlet port 14*a* of the filter box 14, it is preferable that the protruded portion 12*b* is provided on the outer periphery of the constricted part by adhering an appropriate filling material or molding material to approximately to the same diameter as the inlet side pipe 12 so that the strength of this portion is increased.

Further, the filter box 14 is tapered from the inlet port 14*a* towards inside the filter box 14 to form a bell-bottomed shape expanding towards the filter diameter, and after passing the filter 15 on the contrary, similarly tapered to converge in a bell-bottomed shape towards the outlet side pipe 13.

In the thus constructed first embodiment of the present invention, the inlet side pipe 12 having the diameter d1 is tapered down at the connection part with the filter box 14, diameter of the outlet port of the tapered tip part 12*a* is the same diameter d2 as that of the inlet port 14*a* of the filter box 14, and the inlet side pipe 12 and the outlet side pipe 13 are the same in diameter, where since the filter 15 has a diameter of D, there is a relation of D>d1>d2 among these diameters d1, d2, and D.

In the above-described first embodiment of the ink-jet recording head of the present invention, the filter device 10 is disposed which has the filter box 14 provided with the filter 15 for preventing contamination of fine dust in the passage for supplying the ink to the common liquid chamber of the grooved ceiling plate 2, the inside diameter d1 of the inlet side pipe 12 at the inlet side of the box member 16 of the filter box 14 is narrowed by one step, and at the part before immediately expanding to a bell-bottomed shape towards the diameter of the filter 15, is formed in an orifice-shape having a diameter d2 at the hole of the outlet port of the tip part 12*a*. As a result, the flow rate of the ink passing through this part is increased, and it can offset a decrease in flow rate due to the expansion in the bell-bottomed shape towards the filter 15 having the diameter D to prevent a generation of a bubble due to a stagnation of the ink. Further, by the ink flow increased in flow rate by passing through the inlet port 14*a*, a turbulent flow of the ink is generated in the interior of the filter box member 16, even when a bubble adheres to the surface at the ink inlet side of the filter, the bubble is divided into small pieces so that they can pass through the filter and move upward (to the downstream side).

Still further, even when a bubble is generated for some reason, by the above-described increase of the ink flow rate and the generation of a turbulent flow, the bubble can be destructed to flow into the common liquid chamber of the recording head through the filter 15 to be discharged from the discharge port of the ink discharge port surface 2*a*, that is, from the nozzle, thereby it can construct a highly reliable ink-jet recording head without an occurrence of an unstable discharge or an insufficient ink refill.

Here, the inside diameter d1 of the ink inlet pipe 12 can be determined so that an ink supply failure is not generated to the head when the ink flow rate is a maximum, and the filter diameter is a minimum in view of a down-sizing of the apparatus itself. The maximum value of the ink flow rate can be calculated from the number of the discharge ports of the recording head, the ink discharge amount from the discharge port, the driving frequency and the like, and when the respective values are increased, the maximum value of the ink flow rate is required to be estimated at a large value. In the case of the present embodiment of a so-called full-line type recording head which has a large number of discharge ports (actually 300 or more), since the driving frequency is about 2 to 5 (KHz) which is not so high, according to an experiment conducted by the inventors, it has been confirmed that the above-described insufficient supply is not generated when the diameter d1>10 (mm).

Yet further, as to the tapered shape of the tip part 12*a* of the inlet pipe, since a loss coefficient ξ due to a rapid reduction loss is increased if it has a stepped shape, it is desirable that the tapered shape be such that the sectional area continuously decreases with respect to the ink flow direction (vertical upward). Then, the inventors have determined the inner surface shape of the tip part 12*a* to be approximately a truncated conical shape, where an angle is θ between the part of continuously changing cross-sectional shape and the inside wall of the ink flow passage, investigated an optimum range of the angle θ and obtained the result shown in Table 1 below.

TABLE 1

| Sample | d1 (mm) | d2 (mm) | θ (deg.) | Presence of remaining bubble |
|---|---|---|---|---|
| 1 | 10 | 5 | 10 | x |
| 2 | 10 | 5 | 20 | x |
| 3 | 10 | 5 | 30 | ○ |
| 4 | 10 | 5 | 40 | ○ |
| 5 | 10 | 5 | 45 | ○ |
| 6 | 10 | 5 | 50 | x |

From Table 1, it has been confirmed that in the case of the angle 30°≦θ≦45°, the above effect be provided without reducing the effect by the increased flow rate, and without finding a phenomenon of the reduction in the flow rate because this part acts as a resistance.

Further, as to the relation between the diameters d1 and d2, although depending on the magnitude of the inside diameter d1, when the investigation has been conducted on the condition to divide the bubble formed on the filter into smallest sizes under the conditions of the diameter d1=10 mm, the angle 30°≦θ≦45° the results shown in Table 2 have been obtained.

TABLE 2

| Sample | d1 (mm) | d2 (mm) | Presence of remaining bubble |
|---|---|---|---|
| 1 | 10 | 10 | x |
| 2 | 10 | 8 | x |
| 3 | 10 | 5 | ○ |
| 4 | 10 | 3 | ○ |
| 5 | 10 | 2.5 | ○ |
| 6 | 10 | 2 | x |

As can be seen from Table 2, it has been confirmed that the remaining bubble on the filter be finely divided in the range of the ratio of the diameters 2≦d1/d2≦4. In the case of the present embodiment, in particular, according to an experiment by the inventors, it has been found that the bubble has divided into the smallest sizes at the time of the diameter d1=2d2.

As to the range of the above angle θ, the range of the angle 30°≦θ≦45° can provide the above effect without being affected by the respective diameters when the diameters d1 and d2 meet the above desirable relation.

(Embodiment 2)

Figure 3:
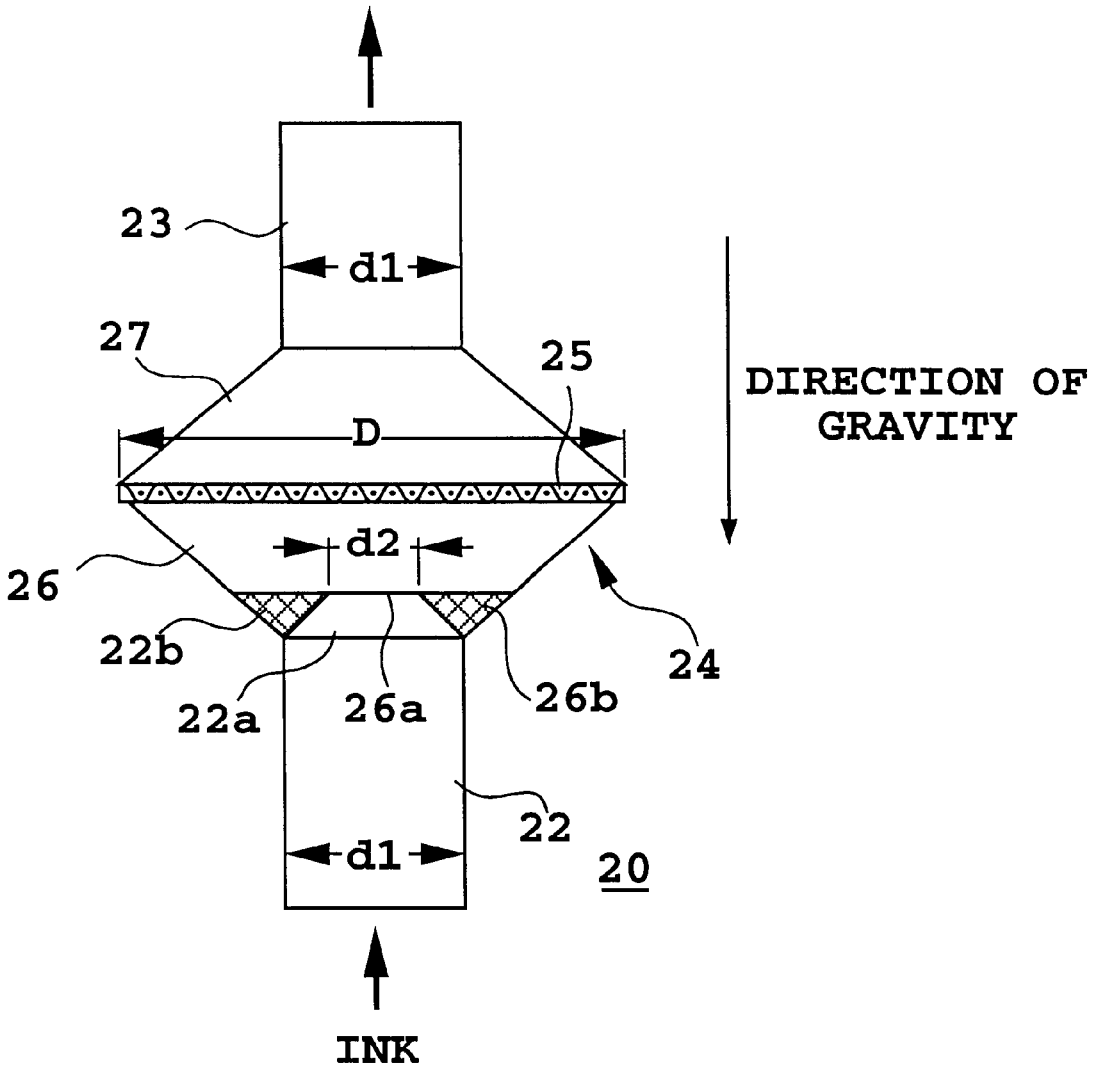
FIG. 3 is a vertical sectional view showing a modified-example of a filter box of the ink-jet recording head according to the present invention.

FIG. 3 illustrates a second embodiment of the ink-jet recording apparatus according to the present invention, of which the basic construction of an inlet side pipe 22, an outlet side pipe 23, a filter 25 and the like is the same as in the first embodiment. In the second embodiment, a top surface 26*b* of the inlet side box member 26 of a filter box 24 is broad and flat, and an inlet port 26*a* is provided at the center to form an orifice.

Consequently, the constricted part on the periphery of the part joining the tip part 22*a* of the inlet side pipe 22 with the top surface 26*b* of the box member 26 is provided with a protruded part 22*b* by adhering an appropriate filling material or molding material to make the outer peripheral surface in flat.

Also in the thus constructed second embodiment of the present invention, as in the first embodiment, since the inside diameter d1 of the inlet side pipe 22 to the ink inlet side box member 26 of the filter box 24 is reduced by one step, immediately before expanding into a bell-bottomed shape towards the outer diameter of the filter 25, that is, forming an orifice shape having a diameter d2 at the hole of the outlet port of the tip part 22*a*, thus the flow rate of the ink passing this part is increased. Further, the ink flow rate is relaxed in the box member 26 having a cross-sectional area sharply changing by expanding into the bell-bottomed shape towards the filter 25 having a diameter D to offset with each other, thereby preventing generation of a bubble due to a stagnation of the ink.

Still further, even when a bubble is generated, since, by the above increased ink flow rate, the bubble is divided to flow the ink into the common liquid chamber of the recording head through the filter 25, and the ink is discharged from the ink discharge port, thereby a highly reliable ink-jet recording head can be obtained without an occurrence of an unstable discharge or an insufficient ink refill.

(Embodiment 3)

Figure 4:
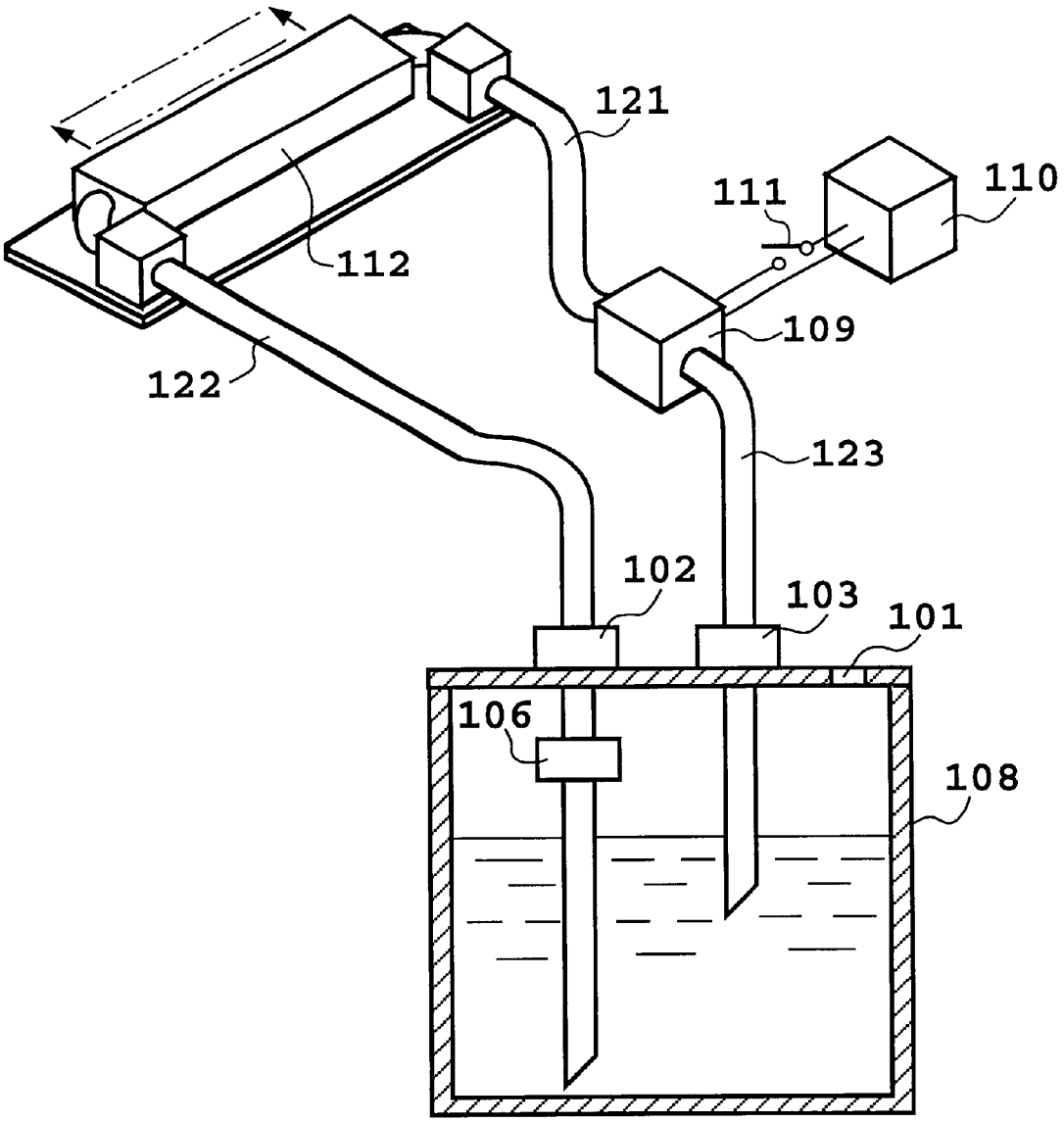
FIG. 4 is a schematic explanation view showing an example of a liquid supply device according to the present invention.

FIG. 4 illustrates a third embodiment of the ink-jet recording apparatus of the present invention. In the present embodiment, unlike the above first and second embodiments, the above-described filter device is provided in a replaceable ink tank, rather than the recording head.

In FIG. 4, numeral 108 denotes an ink tank as an ink containing part, which is provided with an atmosphere communicating hole 101 for communicating with the atmosphere and an ink supply port 102 for conducting the ink to the outside. 103 is an ink inlet port for introducing a recirculated ink. 109 is a pump for pumping the ink, 110 is a power supply for driving the pump, and 111 is a switch for controlling the drive. Normally, the ink blows from the ink tank, passing through the filter device 106 of the present invention and through an ink supply passage 122 to the head 112. During a recovery operation such as a bubble elimination, the ink is recirculated by pumping from the head through an ink supply passage 121 as an ink return passage to the ink tank.

Also in such an ink supply path, by applying the filter of the present invention, the same effect as in the above first and second embodiments can be provided. In this case, it is needless to say that the specification of the more preferable range of the angle θ, and the diameters d1 and d2 described in the above embodiments can also be applied to the present embodiment.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied to either on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of the temperature 30°–70° so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces to the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink supply device having an ink flow passage for communicating an ink containing part for containing an ink with a discharge part for discharging said ink, saidink flow passage containing a dilter device including a planar filter and a filter box for containing said planar filter and provided with an ink inlet port and an ink outlet port, wherein an area at an ink inlet port said filter box is disposed beneath an area at an ink outlet port side of said filter box, and an inner diameter of the ink flow passage at the ink inlet port side of said filter box is narrowed in diameter to be smaller than an inside diameter of said ink flow passage immediately before expanding into a bell-bottomed shape towards said filter, wherein a turbulent flow of the ink is generated in an interior of the filter box by the inner diameter of the ink flow passage at the ink inlet port side ofthe filter box so that an air bubble adhering to the planar filter is finely divided into small pieces to make the small pieces move to a downstream side of the filter.

2. The ink supply device as claimed in claim 1, wherein the inner diameter of the ink flow passage at the ink inlet port side includes a tapered tip section having an inner diameter d2, and wherein an inside diameter d1 of the ink flow passage at the ink inlet port side of said filter box, the diameter d2, and a filter outside diameter D have a dimensional relation of the diameters $D>d1>d2$.

3. The ink supply device as claimed in claim 2, wherein the inside diameter d1 of said ink inlet flow passage at the ink inlet port side and the tapered tip section inner diameter d2 satisfy a ratio of the diameters $2 \leqq d1/d2 \leqq 4$.

4. The ink supply device as claimed in claim 1, wherein said tapered tip section of the ink flow passage at the ink inlet port side has a continuously changing cross-sectional shape.

5. The ink supply device as claimed in claim 4, wherein an angle $\theta$ between said tapered tip section of ink flow passage at the ink inlet port side having a continuously changing cross-sectional shape and an inside wall of said ink flow passage at the ink inlet port side satisfies an angle $30° \leqq \theta \leqq 45°$.

6. An ink-jet recording head for discharging an ink, comprising:

a filter device having a planar filter and a filter box including an ink inlet side and an ink outlet side with respect to said planar filter, wherein said ink inlet side of said filter box is disposed beneath said ink outlet side of said filter box, and an inside diameter of an ink flow passage at the ink inlet side of said filter box includes a narrowed tip section that is narrowed in diameter to be smaller than an inside diameter of the ink flow passage at the ink inlet side, the narrowed tip section expanding into a bell-bottomed shape towards said filter, wherein a turbulent flow of the ink is generated in an interior of the filter box by the inside diameter of the ink flow passage at the ink inlet side of the filter box so that an air bubble adhering to the planar filter is finely divided into small pieces to make the small pieces move to a downstream side of the filter.

7. The ink-jet recording head as claimed in claim 6, wherein said ink-jet recording head comprises a discharge port formation member having a discharge port, an ink flow passage communicating with said discharge port, a common liquid chamber at a rear of said ink flow passage, and a discharge energy generation element disposed in a part of said ink flow passage for generating a thermal energy utilized for discharging an ink to generate a bubble for discharging the ink, thereby forming flying liquid drops for performing recording.

8. The ink-jet recording head as claimed in claim 6, wherein said filter box is made of a transparent material.

9. The ink-jet recording head as claimed in claim 6, wherein said filter box is made from two truncated conical box members joined at opposing cone surface sides provided with the filter.

* * * * *

UNITED STATES PATENT AND TRADEMARK OFFICE

CERTIFICATE OF CORRECTION

PATENT NO. : 6,250,752 B1
DATED : June 26, 2001
INVENTOR(S) : Hiroki Tajima et al.

It is certified that error appears in the above-identified patent and that said Letters Patent is hereby corrected as shown below:

Title page,
Item [56] Reference Cited, FOREIGN PATENT DOCUMENTS, "2236847 1/1999 (GB)." should read -- 2326847 1/1999 (GB). --.
Item [57] ABSTRACT,
Line 10, "a" should be deleted.

Column 3,
Line 13, "an" should read -- and --
Line 40, "filter 16" should read -- filter 15 --.
Line 62, "these" should read -- the --.

Column 5,
Line 12, "d1>10 (mm)." should read -- d1≥10 (mm). --.
Line 39, "be" should read -- can be --.
Line 48, "30° ≤ θ ≤45°" should read -- 30° ≤ θ ≤ 45°, --.
Line 64, "be" should read -- can be --.

Column 7,
Line 55, "consists" should read -- consist --.

Column 8,
Line 66, "saidink" should read -- said ink --.
Line 67, "dilter" should read -- filter --.

UNITED STATES PATENT AND TRADEMARK OFFICE

CERTIFICATE OF CORRECTION

PATENT NO. : 6,250,752 B1
DATED : June 26, 2001
INVENTOR(S) : Hiroki Tajima et al.

It is certified that error appears in the above-identified patent and that said Letters Patent is hereby corrected as shown below:

Column 9,
Line 3, "port" should read -- port side of --.
Line 13, "ofthe" should read -- of the --.
Line 33, "of" should read -- of the --.

Signed and Sealed this

Twenty-eighth Day of May, 2002

*Attest:*

*Attesting Officer*

JAMES E. ROGAN
*Director of the United States Patent and Trademark Office*